US009099054B2

(12) United States Patent
Kim

(10) Patent No.: US 9,099,054 B2
(45) Date of Patent: Aug. 4, 2015

(54) LIQUID CRYSTAL DISPLAY AND DRIVING METHOD THEREOF

(71) Applicant: LG DISPLAY CO., LTD., Seoul (KR)

(72) Inventor: Sangho Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 311 days.

(21) Appl. No.: 13/686,795

(22) Filed: Nov. 27, 2012

(65) Prior Publication Data

US 2013/0141320 A1 Jun. 6, 2013

(30) Foreign Application Priority Data

Dec. 2, 2011 (KR) ..... 10-2011-0128181

(51) Int. Cl.
*G09G 3/36* (2006.01)

(52) U.S. Cl.
CPC ..... *G09G 3/3685* (2013.01); *G09G 3/3688* (2013.01); *G09G 2310/0297* (2013.01); *G09G 2310/08* (2013.01)

(58) Field of Classification Search
USPC ..... 345/84–104
See application file for complete search history.

(56) References Cited

U.S. PATENT DOCUMENTS 7,738,512 B2 * 6/2010 Shin ..... 370/536
2006/0125738 A1 * 6/2006 Kim et al. ..... 345/76

FOREIGN PATENT DOCUMENTS

CN 1776796 A 5/2006

OTHER PUBLICATIONS

Chinese First Office Action, Chinese Application No. 201210441468.5, Jun. 26, 2014, 10 pages.

* cited by examiner

*Primary Examiner* — Keng Chang
*Assistant Examiner* — Scott Au
(74) *Attorney, Agent, or Firm* — Fenwick & West LLP

(57) ABSTRACT

A liquid crystal display generates k DEMUX control signals for controlling the turn-on time of the DEMUX switches so as not to overlap with each other, and generates at least some of the DEMUX control signals every 2 horizontal periods, and makes 1 pulse sustaining period of the DEMUX control signals generated every 2 horizontal periods to overlap with a tail portion of the preceding horizontal period and a front portion of the subsequent horizontal period, among two neighboring horizontal periods.

14 Claims, 11 Drawing Sheets

LIQUID CRYSTAL DISPLAY AND DRIVING METHOD THEREOF

CROSS-REFERENCE TO RELATED APPLICATION

This application claims priority to Republic of Korea Patent Application No. 10-2011-0128181 filed on Dec. 2, 2011, which is incorporated herein by reference in its entirety.

BACKGROUND

1. Field

The present invention relates to a liquid crystal display, and more particularly, to a liquid crystal display which can reduce the number of output channels of a data driving circuit and a driving method thereof.

2. Description of the Related Art

A liquid crystal display displays an image by adjusting the light transmittance of liquid crystal using an electric field. Such a liquid crystal display comprises a liquid crystal display panel having liquid crystal cells arranged in a matrix form and driving circuits for driving the liquid crystal cells.

On the liquid crystal display panel, as shown in FIG. 1, a gate line GL and a data line DL cross each other, and a thin film transistor (hereinafter, referred to as "TFT") for driving the liquid crystal cell Clc is formed at a crossing of the gate line GL and the data line GL. The TFT supplies a data voltage Vd supplied via the data line DL to a pixel electrode Ep of the liquid crystal cell Clc in response to a scan pulse supplied via the gate line GL. To this end, a gate electrode of the TFT is connected to the gate line GL, a source electrode thereof is connected to the data line DL, and a drain electrode thereof is connected to the pixel electrode Ep of the liquid crystal cell Clc. The liquid crystal cell Clc displays gray levels by a potential difference between the data voltage Vd supplied to the pixel electrode Ep and a common voltage Vcom supplied to a common electrode Ec. The common electrode Ec is formed at an upper glass substrate or a lower glass substrate of the liquid crystal display panel depending upon a method of applying an electric field to the liquid crystal cell Clc. A storage capacitor Cst is formed between the common electrode Ec and the pixel electrode Ep of the liquid crystal cell Clc to maintain a voltage charged in the liquid crystal cell Clc.

The driving circuit board comprises a data driving circuit for converting digital video data into analog video data voltages and supplying the analog video data voltages to the data lines of the liquid crystal display panel. Typically, as shown in FIG. 2, output channels S1 to S9 of the data driving circuit 10 are connected one to one to the data lines D1 to D9 formed on the liquid crystal display panel 20. The data driving circuit 10 is typically more expensive than other parts. Therefore, attempts have been made continuously to reduce the number of output channels of the data driving circuit 10 by connecting the output channels of the data driving circuit to the data lines at a ratio of 1:2, 1:3, 1:4, 1:5, or lower.

FIG. 3 shows an example in which output channels S1, S2, and S3 of the data driving circuit 10 are connected to the data lines D1 to D9 at a ratio of 1:3 through a conventional sampling switching circuit 30. The sampling switching circuit 30 time-divides a data voltage output through an output channel and distributes the time-divided data voltage to three data lines. The time division operation in the sampling switching circuit 30 is performed by DEMUX switches MT1, MT2, and MT3 which are sequentially turned on by DEMUX control signals DM1, DM2, and DM3.

The DEMUX control signals DM1, DM2, and DM3 are generated such that they are sequential within 1 horizontal period 1H and do not overlap with each other. A generation cycle of the DEMUX control signals DM1, DM2, and DM3 is set to about 1 horizontal period 1H. In FIG. 4, 'Hsync' indicates a horizontal synchronization signal, '(1)' indicates an interval between scan pulses applied to neighboring gate lines, '(2)' and '(5)' indicate an interval between a scan pulse and a DEMUX control signal, '(3)' indicates a pulse width of a DEMUX control signal (corresponding to a turn-on period of the DEMUX switches), and '(4)' indicates an interval between neighboring DEMUX control signals.

The conventional driving method has the following problem because the DEMUX controls signals are generated in the same cycle (interval of 1H).

In accordance with the conventional driving method, the higher the resolution of the liquid crystal display panel and the higher the distribution ratio, the more difficult it is to ensure a timing margin for the DEMUX control signals. Especially, unless the interval of '(4)' of FIG. 4 is ensured, data voltages, which have to be temporally divided and supplied, are mixed with each other and therefore an unwanted charging result is produced. The reason why it is difficult to ensure a timing margin is because the width of 1 horizontal period 1H decreases depending on the resolution of the liquid crystal display panel and the distribution ratio as in the following Table 1.

TABLE 1

| | | | | DEMUX switch turn-on time [usec] | | |
|---|---|---|---|---|---|---|
| | Vertical Resolution | Horizontal Resolution | 1 H time [usec] | 1:2 distribution | 1:3 distribution | 1:6 distribution |
| VGA | 480 | 640 | 24.51 | 10.75 | 6.84 | 3.21 |
| WVGA | 480 | 800 | 19.84 | 8.42 | 5.28 | 2.43 |
| qHD | 540 | 960 | 16.67 | 6.83 | 4.22 | 1.90 |
| WSVGA | 600 | 1024 | 15.66 | 6.33 | 3.89 | 1.74 |
| WXGA | 768 | 1280 | 12.63 | 4.81 | 2.88 | 1.23 |
| WSXGA+ | 1050 | 1680 | 9.69 | 3.34 | 1.90 | 0.74 |
| HD1080 | 1080 | 1920 | 8.50 | 2.75 | 1.50 | 0.54 |

Also, the higher the resolution of the liquid crystal display panel, the narrower the width of 1 horizontal period 1H. Therefore, the driving frequency of the DEMUX switches which are turned on every 1 horizontal period 1H, that is, the frequency of the DEMUX control signals, increases. As the frequency fDeMUX of the DEMUX control signals increases, the power consumption PDeMUX of the sampling switching circuit increases as in the following Equation 1:

$$P_{DeMUX}=Cdm\times V_{DeMUX}^2\times f_{DeMUX}, \quad \text{Equation 1}$$

here, $f_{DeMUX}=f_{Frame}\times H_{Total}$ wherein 'fFrame' indicates frame frequency, 'HTotal' indicates the number of horizontal lines of the liquid crystal display panel, 'Cdm' indicates the parasitic capacitance of signal lines for supplying the DEMUX control signals DM1 to DM3, as shown in FIG. 5, and 'VDeMUX' indicates the swing width of the DEMUX control signals. In FIG. 5, 'Rdm' denotes the line resistance of the signal lines for supplying the DEMUX control signals DM1 to DM3.

SUMMARY

Accordingly, an aspect of the present invention is to provide a liquid crystal display which ensures a timing margin for DEMUX control signals even though a liquid crystal display panel has a high resolution, and has lower power consumption, and a driving method thereof.

To accomplish the above aspect, according to an exemplary embodiment of the present invention, there is provided a liquid crystal display comprising: a liquid crystal display panel comprising a plurality of data lines and a plurality of gate lines crossing each other and liquid crystal cells formed at crossing of the data and gate lines; a data driving circuit for generating a data voltage; a sampling switching circuit which comprises k DEMUX switches (where k is a positive integer greater than 2) connected to the same output channel of the data driving circuit, and configured to time-divide the data voltage by a switching operation of the DEMUX switches and further configured to distribute the time-divided data voltages to the data lines at a ratio of 1:k; and a DEMUX control signal generation circuit which generates k DEMUX control signals for controlling the turn-on time of the DEMUX switches so as not to overlap with each other, wherein at least some of the DEMUX control signals is generated every 2 horizontal periods, and 1 pulse sustaining period of the DEMUX control signals generated every 2 horizontal periods overlaps with a tail portion of the preceding horizontal period and a front portion of the subsequent horizontal period, among two neighboring horizontal periods.

BRIEF DESCRIPTION OF THE DRAWINGS

The accompany drawings, which are included to provide a further understanding of the invention and are incorporated on and constitute a part of this specification, illustrate embodiments of the invention and together with the description serve to explain the principles of the invention.

DETAILED DESCRIPTION

Hereinafter, an exemplary embodiment of the present invention will be described in detail with reference to FIGS. 6 to 13.

Figure 6:
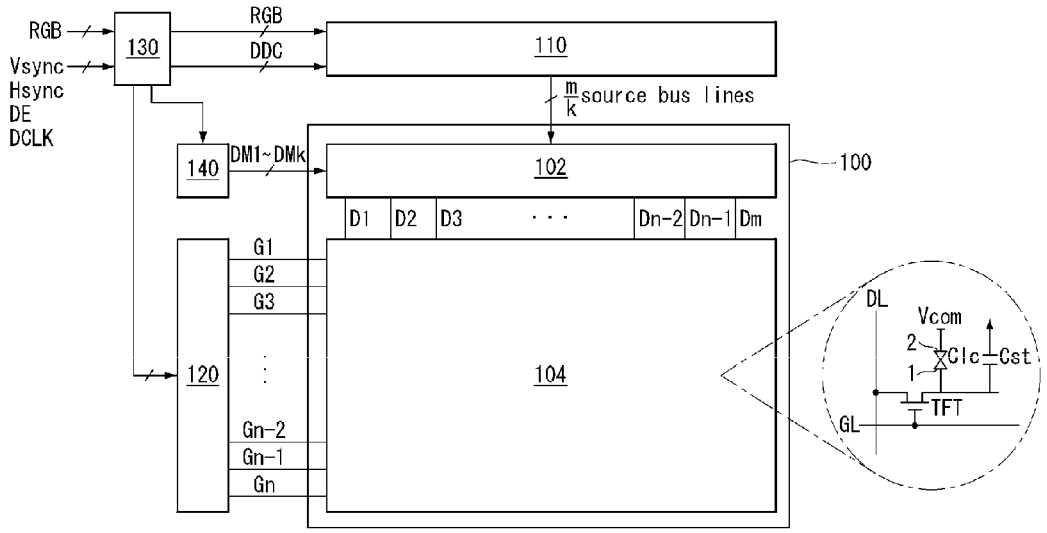
FIG. 6 is a block diagram showing a liquid crystal display according to an exemplary embodiment.

FIG. 6 is a block diagram showing a liquid crystal display according to an exemplary embodiment of the present invention.

Referring to FIG. 6, the liquid crystal display according to the exemplary embodiment of the present invention comprises a liquid crystal display panel 100, a sampling switching circuit 102, a data driving circuit 110, a gate driving circuit 120, a timing controller 130, and a DEMUX control signal generation circuit 140.

The liquid crystal display panel 100 comprises liquid crystal molecules disposed between two glass substrates. The liquid crystal display panel 100 comprises m×n (m and n are positive integers) liquid crystal cells Clc disposed in a matrix form based on a crossing structure of data lines D1 to Dm and gate lines G1 to Gn.

A lower glass substrate of the liquid crystal display panel 100 comprises a pixel array 104 comprising m data lines D1 to Dm, n gate lines G1 to Gn, TFTs, pixel electrodes 1 of the liquid crystal cells Clc connected to the TFTs, and storage capacitors Csts. The pixel array 104 comprises a plurality of pixels for displaying an image. Each of the pixels comprises a plurality of R liquid crystal cells for red display, a plurality of G liquid crystal cells for green display, and a plurality of B liquid crystal cells for blue display.

A black matrix, a color filter, and a common electrode 2 are formed on the upper glass substrate of the liquid crystal display panel 10. In a vertical electric field driving manner such as a twisted nematic (TN) mode and a vertical alignment (VA) mode, the common electrode 2 is formed on the upper glass substrate. In a horizontal electric field driving manner such as an in-plane switching (IPS) mode and a fringe field switching (FFS) mode, the common electrode 2 is formed on the lower glass substrate along with the pixel electrode 1.

Polarizing plates whose optical axes are orthogonal to each other are attached on the upper substrate and lower substrate of the liquid crystal panel 100, respectively. Alignment layers for setting a pre-tilt angle of liquid crystals are respectively formed on the inner surfaces contacting the liquid crystals in the upper and lower glass substrates.

The data driving circuit 110 converts input digital video data R, G, and B into an analog data voltage under control of the timing controller 130. The data driving circuit 110 supplies this analog data voltage to m/k source bus lines through m/k (k is a positive integer greater than 2) output channels.

Figure 7:
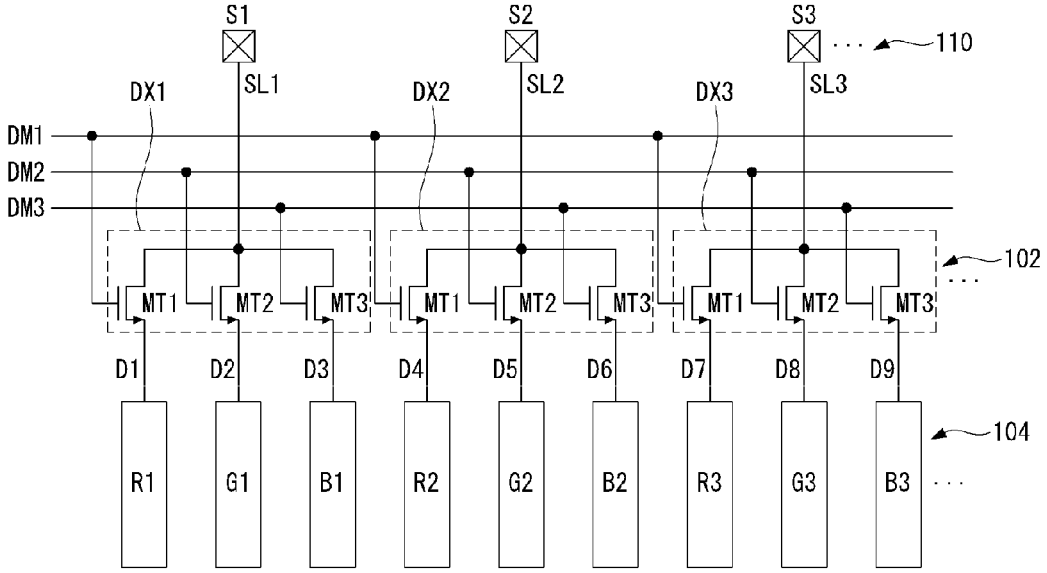
FIG. 7 shows the configuration of a sampling switching circuit for distributing data voltages at a ratio of 1:3.
Figure 8:
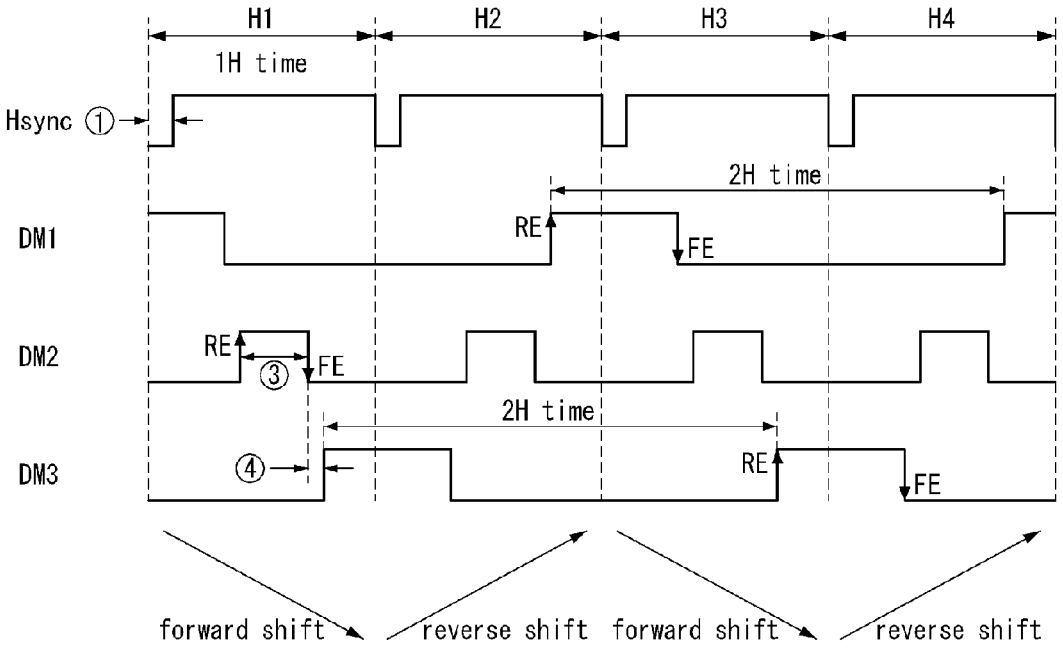
FIG. 8 shows generation timings of DEMUX control signals for driving the sampling switching circuit of FIG. 7.
Figure 9:
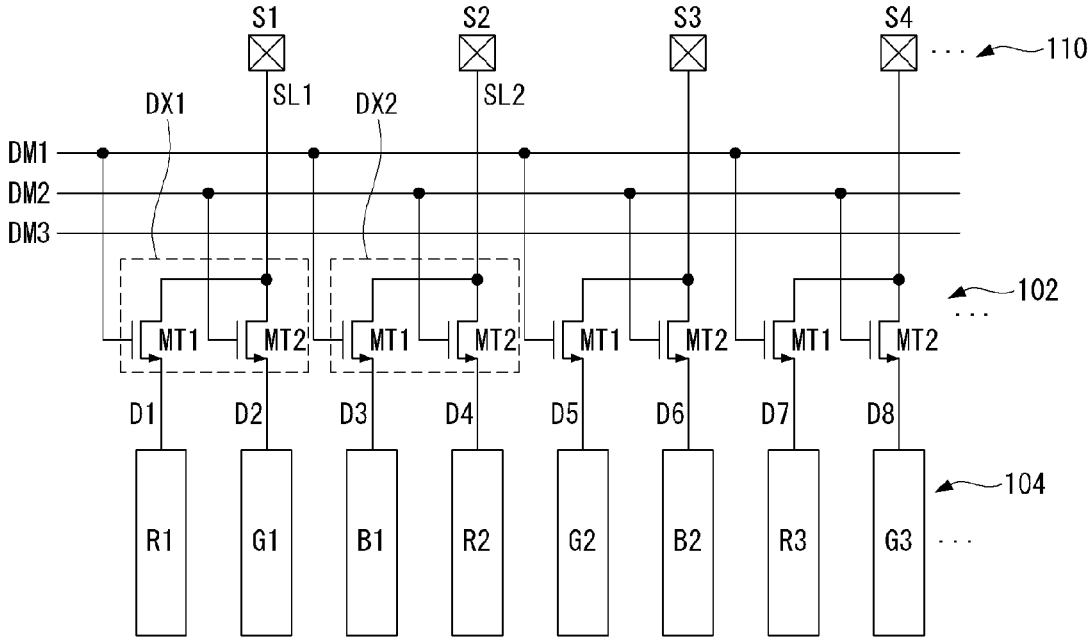
FIG. 9 shows the configuration of a sampling switching circuit for distributing data voltages at a ratio of 1:2.

The sampling switching circuit 102 is connected between the m/k source bus lines and the m data lines D1 to Dm to time-divide the data voltage input from the source bus lines and distribute the time-divided data voltages to the data lines D1 to Dm at a ratio of 1:k. In one embodiment, the sampling switching circuit 102 distributes the data voltages at a ratio of 1:3, as shown in FIG. 7, in response to three DEMUX control signals DM1 to DM3 shown in FIG. 8. In another embodiment, the sampling switching circuit 102 distributes the data voltages at a ratio of 1:2, as shown in FIG. 9, in response to two DEMUX control signals DM1 and DM2 shown in FIG. 10. In still another embodiment, the sampling switching circuit 102 distributes the data voltages at a ratio of 1:4 in response to four DEMUX control signals DM1 to DM4 shown in FIG. 11. In still another embodiment, the sampling switching circuit 102 distributes the data voltages at a ratio of 1:5 in response to five DEMUX control signals DM1 to DM5 shown in FIG. 12. The number of DEMUX switches constituting the sampling switching circuit 102 is determined depending on the distribution ratio. The sampling switching circuit 102 distributes the data voltages input from the m/k source bus lines to the m data lines D1 to Dm, thereby reducing the number of output channels of the data driving circuit 110 by a factor of k, compared to the number of data lines.

The DEMUX control signal generating circuit 140 generates DEMUX control signals DM1 to DMk for controlling the turn-on time of the DEMUX switches included in the sampling switching circuit 102 under control of the timing controller 130. The DEMUX control signal generation circuit 140 generates at least some of the k DEMUX control signals DM1 to DMk every 2 horizontal periods, to ensure a timing margin for the DEMUX control signals and reduce the power consumption of the sampling switching circuit 102. Also, the DEMUX control signal generation circuit 140 sets 1 pulse sustaining period (pulse width) of DEMUX control signals generated every 2 horizontal periods to overlap with a tail portion of the preceding horizontal period and a front portion of the subsequent horizontal period, among two neighboring horizontal periods. DEMUX control signals generated every 2 horizontal periods, among the k DEMUX control signals DM1 to DMk, are the first DEMUX control signal DM1 and the last DEMUX control signal DMk. Since it is required that the k DEMUX control signals DM1 to DMk have a timing margin and do not overlap with each other, the first DEMUX control signal DM1 and the last DEMUX control signal DMk are alternately generated every 1 horizontal period. Accordingly, the order of generation of the k DEMUX control signals DM1 to DMk alternates between forward shift and reverse shift every 1 horizontal period. The forward shift means that the first DEMUX control signal DM1 is generated for the first time and the last DEMUX control signal DMk is generated for the last time and the remaining DEMUX control signals between these signals DM1 and DMk are sequentially generated in a forward direction in accordance with this order of generation. The reverse shift means that the last DEMUX control signal DMk is generated for the first time and the first DEMUX control signal DM1 is generated for the last time and the remaining DEMUX control signals between these signals DM1 and DMk are sequentially generated in a reverse direction in accordance with this order of generation.

The gate driving circuit 120 generates a scan pulse under control of the timing controller 130, and sequentially supplies the scan pulse to the gate lines G1 to Gn, thereby selecting a horizontal pixel line of the pixel array 104 through which data voltages are supplied. The gate driving circuit 120 comprises a shift register for sequentially generating scan pulses and a level shifter for shifting the voltage of each of the scan pulses to an appropriate level suitable for driving the liquid crystal cells. The shift register of the gate driving circuit 120 may be formed directly in a non-display area outside the pixel array 104 of the liquid crystal display panel 100. The level shifter may be mounted on a control printed circuit board (not shown) along with the timing controller 130.

The timing controller 130 controls operation and timing of the data driving circuit 110, gate driving circuit 120, and DEMUX control generation circuit 140 using a horizontal sync signal Hsync, a vertical sync signal Vsync, a data enable signal DE, and a dot clock DCLK supplied from a system (not shown).

A data control signal DDC for controlling the data driving circuit 110 comprises a source start pulse SSP, a source shift clock SSC, a source output enable signal SOE, and a polarity control signal POL. A gate control signal GDC for controlling the gate driving circuit 120 comprises a gate start pulse GSP, a gate shift clock GSC, and a gate output enable signal GOE.

The timing controller 130 aligns the RGB input in the digital video data from the system in accordance with the pixel array of the liquid crystal display panel 100 and supplies the RGB input to the data driving circuit 110. The timing controller 130 controls the DEMUX control signal generation circuit 140 to invert the order of generation of the DEMUX control signals DM1 to DMk in units of frames.

FIG. 7 shows the configuration of a sampling switching circuit for distributing data voltages at a ratio of 1:3. FIG. 8 shows generation timings of DEMUX control signals for driving the sampling switching circuit of FIG. 7.

Referring to FIG. 7, the sampling switching circuit 102 comprises a first DEMUX unit DX1 connected to a first output channel S1 of the data driving circuit 110 via a first source bus line SL1 and connected to first through third data lines D1, D2, and D3, a second DEMUX unit DX2 connected to a second output channel S2 of the data driving circuit 110 via a second source bus line SL2 and connected to fourth through sixth data lines D4, D5, and D6, and a third DEMUX unit DX1 connected to a third output channel S3 of the data driving circuit 110 via a third source bus line SL3 and connected to seventh through ninth data lines D7, D8, and D9.

Each of the first through third DEMUX units DX1, DX2, and DX3 comprises first through third DEMUX switches MT1, MT2, and MT3 for time-dividing a data voltage input from each of the output channels to which they are connected. The first DEMUX switches MT1 of the first through third DEMUX units DX1, DX2, and DX3 are simultaneously switched in accordance with a first DEMUX control signal DM1, the second DEMUX switches MT2 of the first through third DEMUX units DX1, DX2, and DX3 are simultaneously switched in accordance with a second DEMUX control signal DM2, and the third DEMUX switches MT3 of the first through third DEMUX units DX1, DX2, and DX3 are simultaneously switched in accordance with a third DEMUX control signal DM3.

The first through third DEMUX control signals DM1, DM2, and DM3 are as shown in FIG. 8. In FIG. 8, 'Hsync' indicates a horizontal synchronization signal, '(1)' indicates an interval between scan pulses applied to neighboring gate lines, '(3)' indicates a pulse width of a DEMUX control signal (corresponding to a turn-on period of the DEMUX switches), and '(4)' indicates an interval between neighboring DEMUX control signals.

Referring to FIG. 8, a generation cycle of the first and third DEMUX control signals DM1 and DM3 is set to 2 horizontal periods 2H. The first and third DEMUX control signals DM1 and DM3 do not overlap with each other and are alternately generated every 1 horizontal 1H.

1 pulse sustaining period of the first DEMUX control signal DM1 overlaps with a tail portion of the preceding horizontal period H2 and a front portion of the subsequent horizontal period H3, among two neighboring horizontal periods (e.g., H2 and H3). To this end, a rising edge RE of the first DEMUX control signal DM1 is generated within the preceding horizontal period H2, and a falling edge FE of the first DEMUX control signal DM1 is generated within the subsequent horizontal period H3.

1 pulse sustaining period of the third DEMUX control signal DM3 overlaps with a tail portion of the preceding horizontal period H3 and a front portion of the subsequent horizontal period H4, among two neighboring horizontal periods (e.g., H3 and H4). To this end, a rising edge RE of the third DEMUX control signal DM3 is generated within the preceding horizontal period H3, and a falling edge FE of the third DEMUX control signal DM3 is generated within the subsequent horizontal period H4.

As a generation cycle of the first and third DEMUX control signals DM1 and DM3 increases by two times over that of the conventional art, and hence their frequency decreases to ½ their conventional one. Once the frequency of the first and third DEMUX control signals DM1 and DM3 decreases, the power consumption for a switching operation of the sampling switching circuit 102 also decreases.

Figure 1:
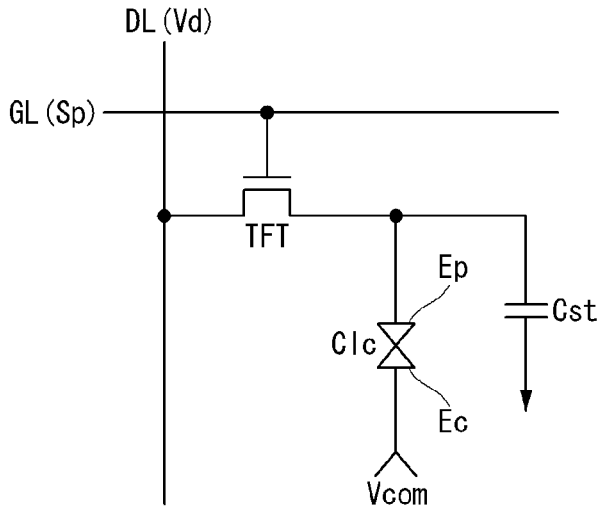
FIG. 1 is an equivalent circuit diagram of a pixel formed on a liquid crystal display panel.
Figure 2:
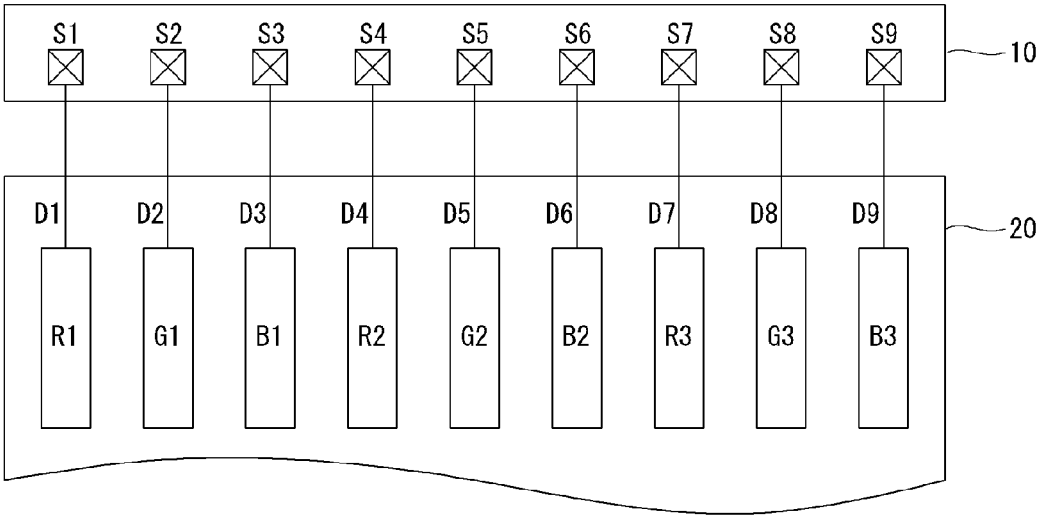
FIG. 2 is a view showing an example in which output channels of a data driving circuit are connected one to one to data lines formed on the liquid crystal display panel.
Figure 3:
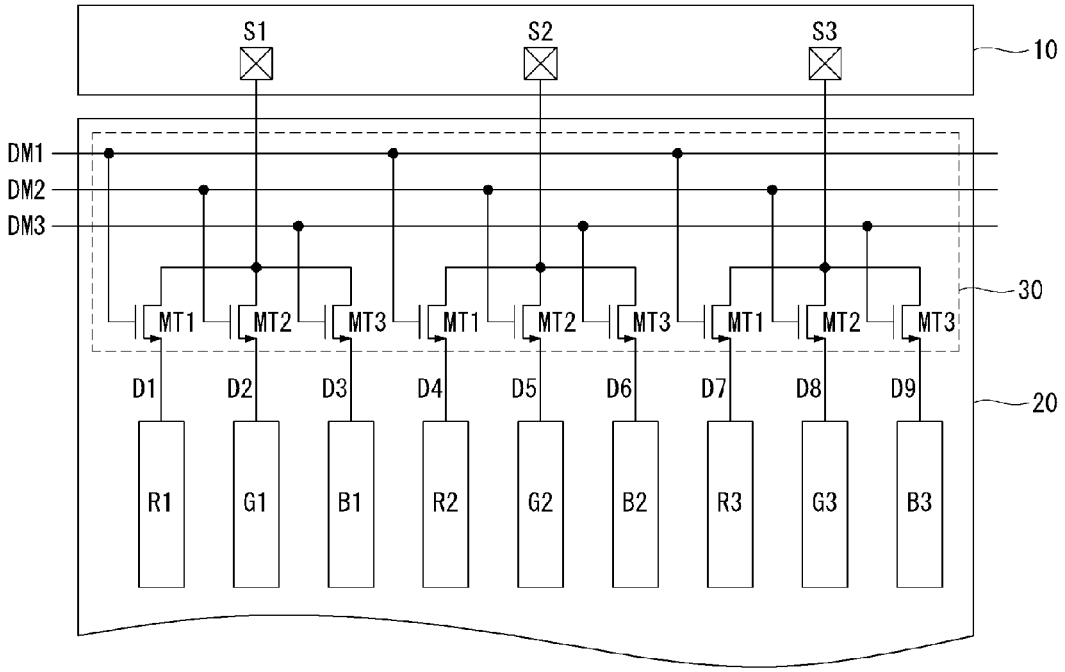
FIG. 3 is a view showing an example in which the output channels of the data driving circuit are connected to the data lines at a ratio of 1:3 through a conventional sampling switching circuit.
Figure 4:
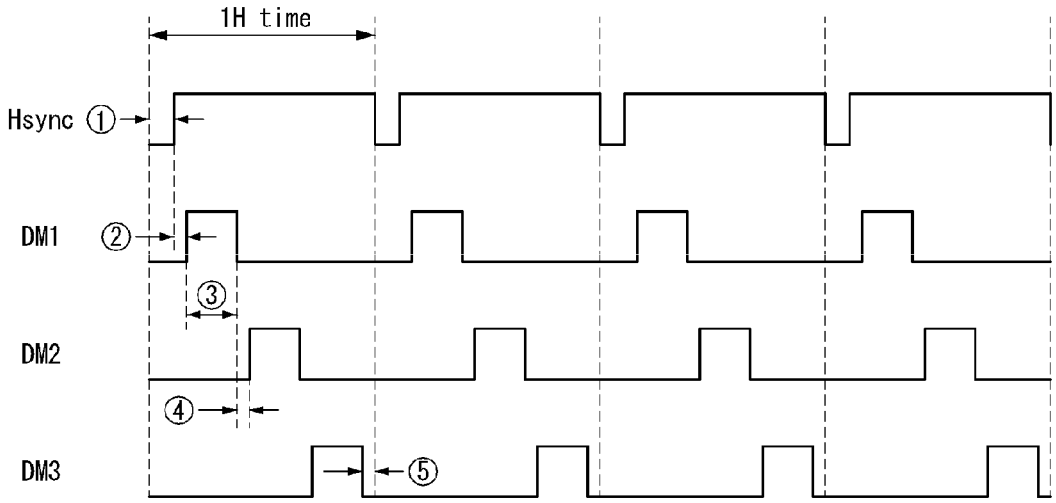
FIG. 4 is a view showing driving timings of DEMUX control signals for driving the sampling switching circuit shown in FIG. 3.
Figure 5:
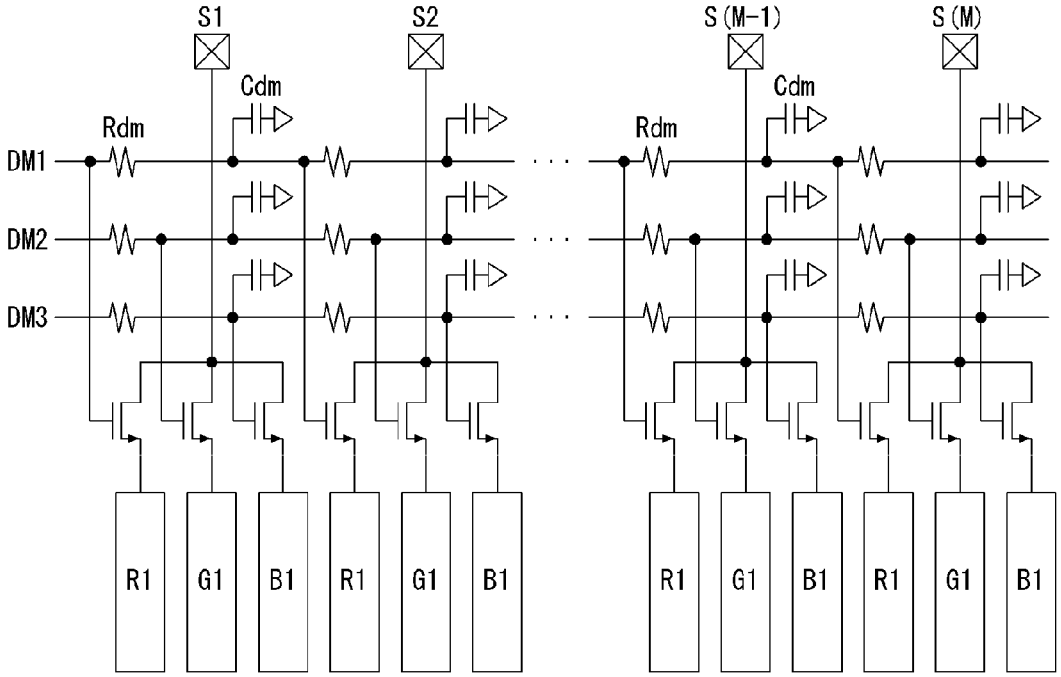
FIG. 5 is a view showing the parasitic capacitance and line resistance of signal lines for supplying the DEMUX control signals.

'(2)' and '(5)' of FIG. 4 indicating an interval between a scan pulse and a DEMUX control signal are not required in FIG. 8. When driving the liquid crystal display as shown in FIG. 8, the existing period corresponding to '(2)' and '(5)' can be used for a timing margin represented by '(4)', thus making it easy to ensure a timing margin at a high resolution where 1 horizontal period 1H is short.

Meanwhile, the second DEMUX control signal DM2 does not overlap with the first and second DEMUX control signals DM1 and DM2, and is generated every horizontal period H1 to H4. That is, a rising edge RE and falling edge FE of the second DEMUX control signal DM2 is generated within one horizontal period.

Therefore, the order of generation of the first to third DEMUX control signals DM1 to DM3 alternates between forward shift and reverse shift every 1 horizontal period 1H.

Figure 10:
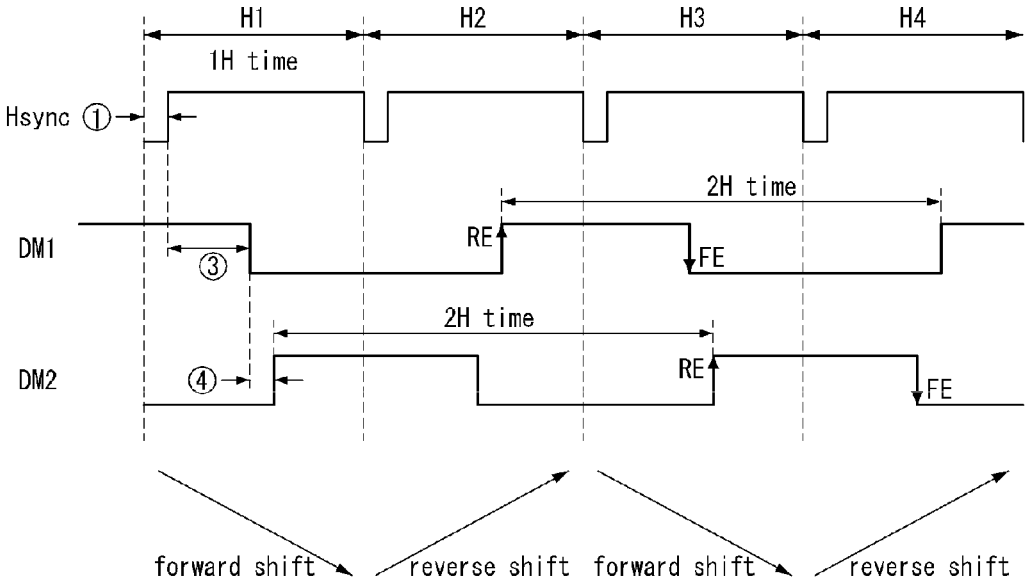
FIG. 10 shows generation timings of DEMUX control signals for driving the sampling switching circuit of FIG. 9.

FIG. 9 shows the configuration of a sampling switching circuit for distributing data voltages at a ratio of 1:2. FIG. 10 shows generation timings of DEMUX control signals for driving the sampling switching circuit of FIG. 9.

Referring to FIG. 9, the sampling switching circuit 102 comprises a first DEMUX unit DX1 connected to a first output channel S1 of the data driving circuit 110 via a first source bus line SL1 and connected to first and second data lines D1 and D2, and a second DEMUX unit DX2 connected to a second output channel S2 of the data driving circuit 110 via a second source bus line SL2 and connected to third and fourth data lines D3 and D4.

Each of the first and second DEMUX units DX1 and DX2 comprises first and second DEMUX switches MT1 and MT2 for time-dividing a data voltage input from each of the output channels SL1 and SL2 to which they are connected. The first DEMUX switches MT1 of the first and second DEMUX units DX1 and DX2 are simultaneously switched in accordance with a first DEMUX control signal DM1, and the second DEMUX switches MT2 of the first and second DEMUX units DX1 and DX2 are simultaneously switched in accordance with a second DEMUX control signal DM2.

The first and second DEMUX control signals DM1 and DM2 are as shown in FIG. 10. The meanings of the reference numerals shown in FIG. 10 are similar to those explained in FIG. 8.

Referring to FIG. 10, a generation cycle of the first and second DEMUX control signals DM1 and DM2 is set to 2 horizontal periods 2H. The first and second DEMUX control signals DM1 and DM2 do not overlap with each other and are alternately generated every 1 horizontal 1H.

1 pulse sustaining period of the first DEMUX control signal DM1 overlaps with a tail portion of the preceding horizontal period H2 and a front portion of the subsequent horizontal period H3, among two neighboring horizontal periods (e.g., H2 and H3). To this end, a rising edge RE of the first DEMUX control signal DM1 is generated within the preceding horizontal period H2, and a falling edge FE of the first DEMUX control signal DM1 is generated within the subsequent horizontal period H3.

1 pulse sustaining period of the second DEMUX control signal DM2 overlaps with a tail portion of the preceding horizontal period H3 and a front portion of the subsequent horizontal period H4, among two neighboring horizontal periods (e.g., H3 and H4). To this end, a rising edge RE of the second DEMUX control signal DM2 is generated within the preceding horizontal period H3, and a falling edge FE of the second DEMUX control signal DM2 is generated within the subsequent horizontal period H4.

As a generation cycle of the first and second DEMUX control signals DM1 and DM2 increases by two times over that of the conventional art, and hence their frequency decreases to ½ their conventional one. Once the frequency of the first and second DEMUX control signals DM1 and DM2 decreases, the power consumption for a switching operation of the sampling switching circuit 102 also decreases.

'(2)' and '(5)' of FIG. 4 indicating an interval between a scan pulse and a DEMUX control signal are not required in FIG. 10. When driving the liquid crystal display as shown in FIG. 10, the existing period corresponding to '(2)' and '(5)' can be used for a timing margin represented by '(4)', thus making it easy to ensure a timing margin at a high resolution where 1 horizontal period 1H is short.

The order of generation of the first and second DEMUX control signals DM1 and DM2 alternates between forward shift and reverse shift every 1 horizontal period 1H.

Figure 11:
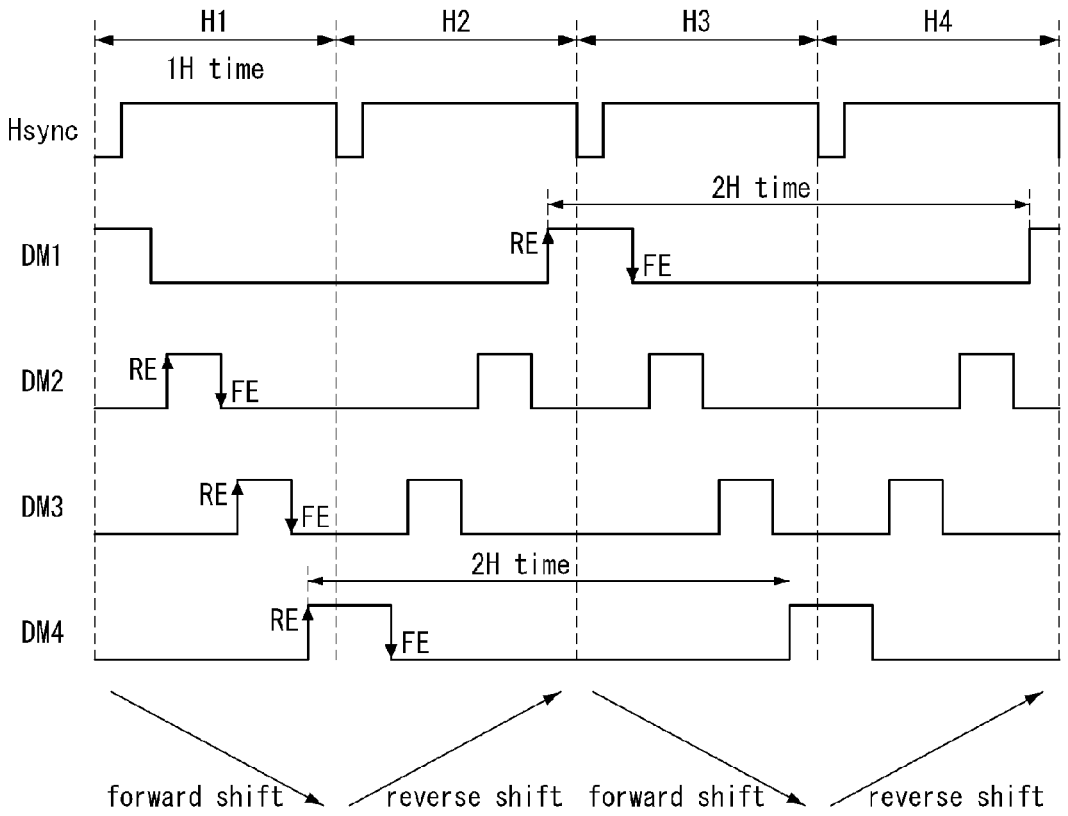
FIG. 11 shows generation timings of DEMUX control signals for distributing data voltages at a ratio of 1:4.

FIG. 11 shows generation timings of DEMUX control signals for distributing data voltages at a ratio of 1:4.

Referring to FIG. 11, to ensure a timing margin and reduce power consumption, a generation cycle of the first and fourth control signals DM1 and DM4 is set to 2 horizontal periods 2H, and the first and fourth DEMUX control signals DM1 and DM4 do not overlap with each other and are alternately generated every 1 horizontal period 1H. The second and third DEMUX control signals DM2 and DM3 do not overlap with the first and fourth DEMUX control signals DM1 and DM4 and are alternately generated every 1 horizontal period 1H to H4. Therefore, the order of generation of the first to fourth DEMUX control signals DM1 to DM4 alternates between forward shift and reverse shift every 1 horizontal period 1H.

Figure 12:
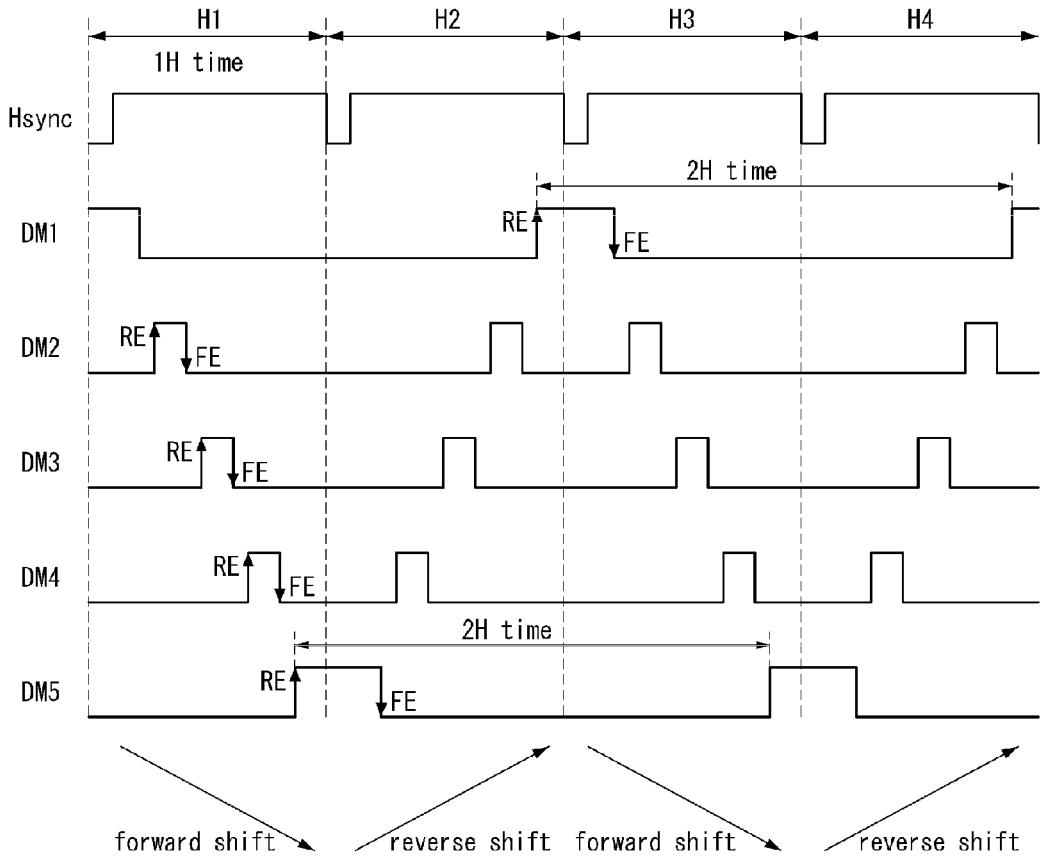
FIG. 12 shows generation timings of DEMUX control signals for distributing data voltages at a ratio of 1:5.

FIG. 12 shows generation timings of DEMUX control signals for distributing data voltages at a ratio of 1:5.

Referring to FIG. 12, to ensure a timing margin and reduce power consumption, a generation cycle of the first and fifth control signals DM1 and DM5 is set to 2 horizontal periods 2H, and the first and fifth DEMUX control signals DM1 and DM5 do not overlap with each other and are alternately generated every 1 horizontal period 1H. The second through fourth DEMUX control signals DM2, DM3, and DM 4 so not overlap with the first and fifth DEMUX control signals DM1 and DM5 and are alternately generated every 1 horizontal period 1H to H4. Therefore, the order of generation of the first through fifth DEMUX control signals DM1 through DM5 alternates between forward shift and reverse shift every 1 horizontal period 1H.

Figure 13:
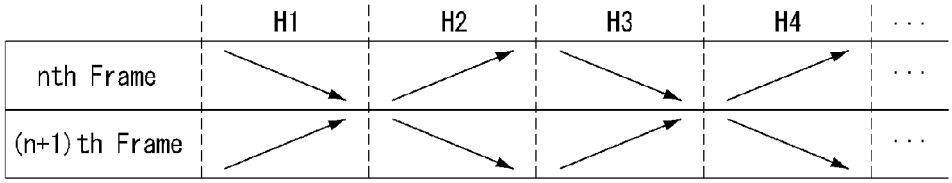
FIG. 13 is a diagram showing inversion of the order of generation of DEMUX control signals per unit of frames.

FIG. 13 shows that the order of generation of DEMUX control signals is inverted in units of frames.

Referring to FIG. 13, the order of generation of DEMUX control signals shown in FIG. 8 and FIGS. 10 to 12 can be controlled to be inverted in units of frames. For example, the order of generation set to forward shift for an n-th frame may be inverted to reverse shift for an (n+1)-th frame. On the contrary, the order of generation set to reverse shift for the n-th frame may be inverted to forward shift for the (n+1)-th frame.

As described above, the first and last DEMUX control signals among a plurality of DEMUX control signals for controlling the turn-on time of DEMUX switches are generated every 2 horizontal periods, rather than every 1 horizontal period, and the first DEMUX control signal and the last DEMUX control signal are alternately generated every horizontal period.

In view of this, the present invention makes it easy to ensure a timing margin for DEMUX control signals at a high resolution and provides the effect of reducing the power consumption for a switching operation of DEMUX switches as much as the frequency of the first and last DEMUX controls signals decreases.

Throughout the description, it should be understood for those skilled in the art that various changes and modifications are possible without departing from the technical principles of the present invention. Therefore, the technical scope of the present invention is not limited to those detailed descriptions in this document but should be defined by the scope of the appended claims.

What is claimed is:

1. A liquid crystal display comprising:

a liquid crystal display panel comprising a plurality of data lines and a plurality of gate lines, the data lines intersecting the gate lines, and further comprising liquid crystal cells formed at intersections of the data lines and gate lines;

a data driving circuit for generating a data voltage, the data driving circuit having a plurality of output channels;

a sampling switching circuit comprising k (DEMUX) switches connected to one of the plurality of output channels of the data driving circuit, wherein k is a positive integer greater than or equal to 2, the sampling switching circuit configured to:

time-divide the data voltage by performing a switching operation of the DEMUX switches, and distribute the time-divided data voltages to the data lines at a ratio of 1:k; and a DEMUX control signal generation circuit which generates k DEMUX control signals for controlling turn-on times of the DEMUX switches so that the turn-on times do not overlap with each other, wherein at least two of the DEMUX control signals are generated every 2 horizontal periods, and wherein 1 pulse sustaining period of the DEMUX control signals generated every 2 horizontal periods overlaps with a tail portion of a preceding horizontal period and a front portion of a subsequent horizontal period among two neighboring horizontal periods.

2. The liquid crystal display of claim 1, wherein a first DEMUX control signal and a last DEMUX control signal are selected as the DEMUX control signals generated every 2 horizontal periods.

3. The liquid crystal display of claim 2, wherein the first DEMUX control signal and the last DEMUX control signal are alternately generated every 1 horizontal period.

4. The liquid crystal display of claim 2, wherein an order of generation of the k DEMUX control signals alternates between forward shift and reverse shift every 1 horizontal period.

5. The liquid crystal display of claim 4, wherein the forward shift means that the first DEMUX control signal is generated for a first time and the last DEMUX control signal is generated for a last time and the DEMUX control signals between the first DEMUX control signal and the last DEMUX control signal are sequentially generated in a forward direction in accordance with this order of generation.

6. The liquid crystal display of claim 4, wherein the reverse shift means that the last DEMUX control signal is generated for a first time and the first DEMUX control signal is generated for a last time and the DEMUX control signals between the last DEMUX control signal and the first DEMUX control signal are sequentially generated in a reverse direction in accordance with this order of generation.

7. The liquid crystal display of claim 4, wherein the order of generation of the DEMUX control signals, which alternates between the forward shift and the reverse shift every 1 horizontal period, is inverted in units of frames.

8. A driving method of a liquid crystal display, the liquid crystal display comprising a liquid crystal display panel comprising a plurality of data lines and a plurality of gate lines, the data lines intersecting with the gate lines, and liquid crystal cells formed at intersections of the data and gate lines, a data driving circuit for generating a data voltage, and a sampling switching circuit comprising k DEMUX switches connected to a same output channel of the data driving circuit, wherein k is an positive integer equal to or greater than 2, the method comprising:

generating k DEMUX control signals for controlling turn-on times of the DEMUX switches so that the turn-on times do not overlap with each other, at least two of the DEMUX control signals generated every 2 horizontal periods, and 1 pulse sustaining period of the DEMUX control signals generated every 2 horizontal periods overlapping with a tail portion of a preceding horizontal period and a front portion of a subsequent horizontal period, among two neighboring horizontal periods;

time-dividing the data voltage by performing a switching operation of the DEMUX switches in accordance with the DEMUX control signals; and distributing the time-divided data voltages to the data lines at a ratio of 1:k.

9. The method of claim 8, wherein a first DEMUX control signal and a last DEMUX control signal are selected as the DEMUX control signals generated every 2 horizontal periods.

10. The method of claim 9, wherein the first DEMUX control signal and the last DEMUX control signal are alternately generated every 1 horizontal period.

11. The method of claim 9, wherein an order of generation of the k DEMUX control signals alternates between forward shift and reverse shift every 1 horizontal period.

12. The method of claim 11, wherein the forward shift means that the first DEMUX control signal is generated for a first time and the last DEMUX control signal is generated for a last time and the DEMUX control signals between the first DEMUX control signal and the last DEMUX control signal are sequentially generated in a forward direction in accordance with this order of generation.

13. The method of claim 11, wherein the reverse shift means that the last DEMUX control signal is generated for a first time and the first DEMUX control signal is generated for a last time and the DEMUX control signals between the last DEMUX control signal and the first DEMUX control signal are sequentially generated in a reverse direction in accordance with this order of generation.

14. The method of claim 11, further comprising inverting the order of generation of the DEMUX control signals, which alternates between the forward shift and the reverse shift every 1 horizontal period, in units of frames.

* * * * *